US006164232A

United States Patent [19]

Beylot

[11] Patent Number: 6,164,232

[45] Date of Patent: Dec. 26, 2000

[54] AUTOMATICALLY OPERATING DUMP VALVE DEVICE FOR A BOAT, PARTICULARLY A LIFE RAFT

[75] Inventor: Gérard Beylot, Nieul-le-Virouil, France

[73] Assignee: Zodiac International, Issy les Moulineaux, France

[21] Appl. No.: 09/217,161

[22] Filed: Dec. 21, 1998

[30] Foreign Application Priority Data

Dec. 29, 1997 [FR] France ..... 97 16618

[51] Int. Cl.[7] ..... B63B 13/00

[52] U.S. Cl. ..... 114/184

[58] Field of Search ..... 441/40, 37, 38, 441/43; 114/68, 183 R, 184, 185, 345, 346, 360, 348

[56] References Cited

U.S. PATENT DOCUMENTS 2,399,494 4/1946 Manson et al. .
2,929,347 3/1960 Veltman ..... 114/183 R
4,790,784 12/1988 Givens .

FOREIGN PATENT DOCUMENTS 36020 3/1967 Finland ..... 114/184
2353433 12/1977 France .
1425573 2/1976 United Kingdom .
2181393 4/1987 United Kingdom .

OTHER PUBLICATIONS

Abstract of Japanese Patent Document No. 07 081666A, Mar. 28, 1995.
French Preliminary Search Report dated Aug. 14, 1998 (2 pages).

*Primary Examiner*—S. Joseph Morano
*Assistant Examiner*—Ajay Vasudeva
*Attorney, Agent, or Firm*—Dean W. Russell; Kilpatrick Stockton LLP

[57] ABSTRACT

An automatically operating dump valve device for a boat, particularly for a life raft, including a hole made in the bottom of the boat and a flexible chute located under the bottom of the boat being connected in a sealed way to the edge of said hole, the chute is equipped with flotation means placed away from its connection with the hole in the bottom of the boat, by means of which arrangement, when there is no water in the boat, the flotation means bring the chute back up under the bottom of the boat sealing it and the water cannot get into the boat through the chute, whereas, when water is present in the boat and is drawn back towards the aforementioned hole, its weight forces the chute end to drop from the bottom of the boat despite the presence of the flotation means and the water flows out through the chute.

14 Claims, 3 Drawing Sheets

AUTOMATICALLY OPERATING DUMP VALVE DEVICE FOR A BOAT, PARTICULARLY A LIFE RAFT

The present invention concerns improvements made to automatically operating dump valve devices for a boat, particularly for a life raft, including a hole made in the bottom of the boat and an approximately flexible chute located under the bottom of the boat being connected in a sealed way to the edge of said hole.

Dump valve devices of the aforementioned type have already been proposed in which the chute hangs approximately vertically under the bottom of the boat when shipped water is being discharged. However, outside discharge times, the chute cannot be left in this configuration since it allows the water the possibility of flowing back into the boat; in particular, when the boat is loaded and its bottom then extends underneath the level of the surrounding water, the chute would allow water to flow back into the boat until equalization of the levels inside and outside the boat.

Therefore, outside discharge times, it is necessary to pull the chute inside the boat and to deactivate its mouth in some way (pinching with a flexible fastening, coiling up the chute, installing a bung, etc.) before completing the discharge of the residual water by bailing.

Conversely, discharging shipped water requires the chute to be placed in an operational position: opening up the hole and dropping the chute under the bottom of the boat.

However, a dump valve device thus arranged has a basic drawback which lies in the lack of automaticity of its operation. Indeed, however uncomplicated the operations disclosed above, they require a minimal knowledge of the sea on the part of people in the boat. But this condition is not fulfilled when the boat is a life raft picking up passengers from a transport ship who, generally speaking, have no knowledge of the sea and are incapable of operating correctly, at the required time, a dump valve device of this type.

There is therefore at the present time a pressing need for an automatically operating dump valve device, which retains as far as absolutely possible the straightforward and inexpensive structure of the aforementioned known dump valve device, and which is of a kind to equip all sorts of boats, particularly life rafts, including life rafts of very large capacity equipping passenger carrying ships (for example car ferries).

To these ends, a dump valve device arranged according to the invention is characterized in that said chute is equipped with flotation means placed away from its connection with the hole in the bottom of the boat, by means of which arrangement, when there is no water in the boat, the flotation means bring the chute back up under the bottom of the boat approximately sealing up said chute and the water cannot get into the boat through the chute, whereas, when water is present in the boat and is drawn back towards the aforementioned hole, its weight forces the chute to drop from the bottom of the boat despite the presence of the flotation means and the water flows out through the chute.

It is possible to arrange for the flotation means to be placed at the end or near the end of the chute, which means that the mouth of the chute in a non-operational position is pinned against the bottom of the boat. It is also possible to arrange for the flotation means to be placed away from the end of the chute, which means that it is an intermediate part of the chute which is pinned against the bottom of the boat while its end hangs free.

In a preferred version, the flotation means consist of at least one pneumatic pocket; to advantage in this case, the pneumatic pocket is formed of at least one hermetically sealed fender containing air and extending on the periphery of the chute, or again as a preferred variant the pneumatic pocket is constituted of two fenders each extending over one respective half of the periphery of the chute.

In combination with this last arrangement, it is preferable to arrange for the chute to be, in the absence of water outflow, of a flattened shape and to have two faces placed one against the other each being provided with one of said flotation fenders, the flattened chute being, in the raised position activated by the flotation means, approximately pinned flat under the bottom of the boat: a better watertight blockage is in this way obtained for the chute in its non-operational position. In a straightforward and inexpensive example of manufacture, the chute can then be formed from a sheet of a flexible material folded flatly in two, the edges being fixed to each other and the fold being pronounced; or else, in a more straightforward and preferred way, the chute is formed of two sheets of a flexible material placed flat against each other and fixed to each other by their respective longitudinal edges.

Still by preference, the mouth of the chute connected to the hole provided in the bottom of the boat is placed laterally on the chute, with the result that the chute in its non-operational position extends approximately parallel to the bottom; in this way raising the chute against the bottom of the boat is facilitated under the action of the flotation means outside discharge times; during discharge, the chute does not extend strictly vertically under the bottom, but extends more or less so.

The chute is to advantage constituted of relatively flexible synthetic material.

In a desirable way, the mouth of the chute fixed to the hole in the bottom of the boat is equipped with a protective grating, so as to prevent objects in the boat from being washed away by the discharged water.

The invention will be better understood from reading the following detailed description of some preferred versions given solely as absolutely non-restrictive examples. In this description, reference will be made to the appended drawing in which.

In the following description, the device of the invention will be described more specifically in relation to a life raft, particularly a raft of large capacity, since it is in this application that the invention seems bound to prove most advantageous, it being understood however that this is given merely as a non-restrictive example and that the invention can have application in life rafts of a different type, or even in boats other than life rafts.

Figure 1A:
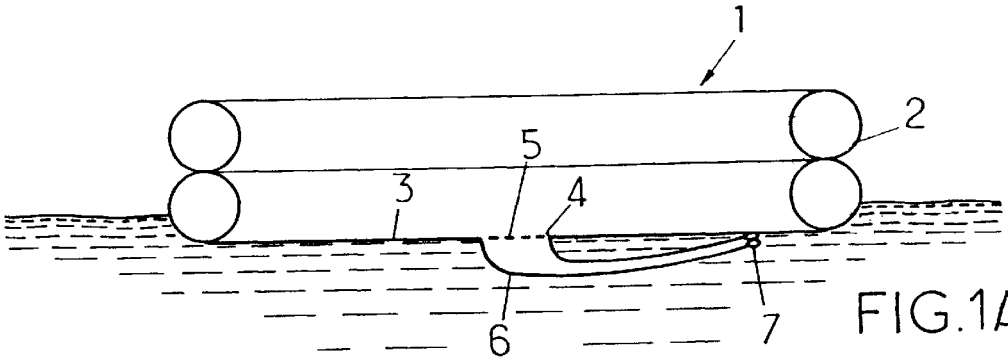
FIGS. 1A and 1B are outline diagrammatic views, in cross-section, of a boat equipped with an automatically operating dump valve device according to the invention, shown two different positions respectively.

By referring firstly to FIG. 1A, a life raft 1 comprises a lateral edge 2 defined for example by two superposed pneumatic fenders. A flexible bottom 3 extends under the lower fender.

Approximately in its central part, or in any other place suitable for constituting the lowest part, the bottom 3 is equipped with a hole 4 being able to be equipped preferably with a protective grating 5 of appropriate design (for example of the so-called "duck's beak" type) for restraining objects.

To the edge of the hole 4 is fixed in a sealed way, under the bottom 3, a chute 6 of a flexible material, for example, a synthetic material, unalterable on contact with the sea.

The chute 6 is equipped with flotation means 7 which, in the example shown in FIG. 1A, are located at its free end. Thus, when the inside of the raft 1 does not contain water (as in FIG. 1A), the flotation means 7 bring the chute 6 back up (here the free end of this chute) and apply it under the bottom 3 of the raft.

By providing flotation means which surround the chute 6, the vertical rising thrust which is exerted on the flexible wall of the chute tends to flatten the chute while pinning it against the bottom 3, so that the chute is thus sealed and the sea water can practically no longer get into the chute and flow back into the raft (equalization of levels in the case of a loaded raft with the bottom located under the level of the water).

Figure 1B:
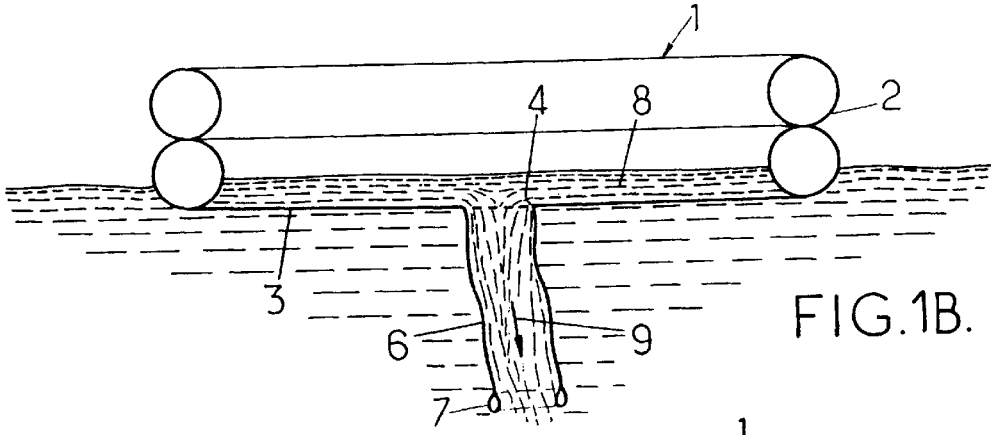

When water 8 has been shipped in the raft (FIG. 1B), the very weight of this water which is drawn back towards the hole 4 acts by gravity on the chute 6 to lower the latter which then extends approximately vertically (or at the very least in a very inclined position) under the bottom 3: the shipped water can then flow away (arrow 9) through the chute 6 until equalization of the water 8 level inside the boat with the sea level. At this point, no counter force opposes the flotation means 7 and the chute 6 is drawn back against the bottom 3 of the raft. The residue of water 8 in the raft can then be discharged by bailing.

By means of the arrangements characteristic of the invention, the removal of the greatest part of the shipped water 8 is carried out entirely automatically, without any participation by the passengers in the raft. Outside periods of discharging water, the chute is positioned, here again automatically, so that the external water cannot flow back into the raft.

Figure 2:
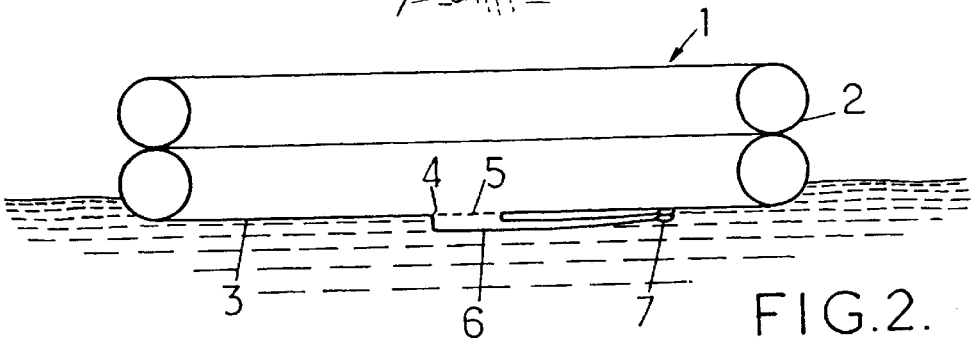
FIG. 2 is an outline diagrammatic view similar to the previous ones, showing a preferred version of the automatically operating dump valve device of the invention.

In FIG. 2 is shown a version variant which constitutes a preferred version. As can be more clearly seen in FIG. 3, the chute 6 has its connection mouth 10 (here equipped with a restraining grating 5 of the aforementioned "duck's beak" type) placed laterally with respect to the chute 6, and not axially. The result is that, in the off or non-discharging position shown in FIG. 2, the chute 6 is connected to the bottom 3 by being pinned against the bottom 3 over almost its entire length and by moving away from the hole 4 in a way approximately parallel to the bottom 3.

Figure 4A:
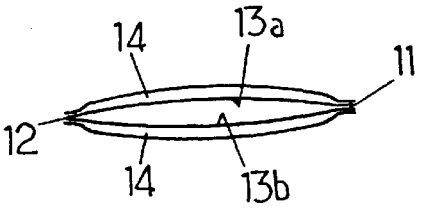
FIGS. 4A and 4B are outline diagrammatic views in cross-section of the end of the device in FIGS. 2 and 3, showing two straightforward version examples.
Figure 4B:
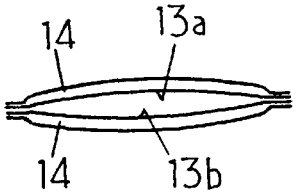

In addition, as shown in FIGS. 4A and 4B, it is to advantage that the chute 6 is constituted in a flattened shape so as, on the one hand, to improve the sealing capacity of the chute at times when water is not being discharged and, on the other hand, to simplify the structure of the chute and to facilitate its manufacture.

In the example in FIG. 4A, the chute 6 is formed by a single sheet 12 of flexible material folded over itself, with the two longitudinal edges 11 fixed (for example welded or bonded) to each other. Conversely, the fold may to advantage be crushed, so that the chute has a general flattened shape with two faces 13*a* (upper face in figure FIG. 3) and 13*b* (lower face visible through the grating 5 in FIG. 3).

In the example in FIG. 4B, the chute is formed by fixing, edge to edge, two sheets of flexible material 13*a*, 13*b* in one 13*a* of which the mouth 10 has been cut out.

The flotation means 7 can be constituted in any appropriate manner and/or in any appropriate material: strip of a floating material fixed to the chute, pocket filled with air integral with the chute, etc.

Figure 3:
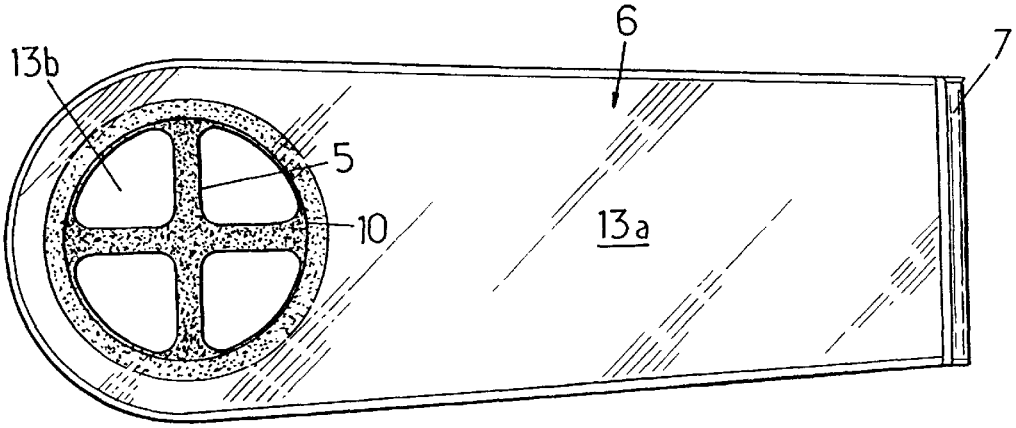
FIG. 3 is a plan view showing, in a more detailed way and on a larger scale a version example of the dump valve device in FIG. 2.

In the example in FIG. 3, outlined also in FIGS. 4A and 4B, there are two elongated air pockets 14 which extend over the whole length of the faces 13*a*, 13*b* respectively. These pockets 14 can be made independently of the faces 13*a*, 13*b* and added (for example bonded or welded) to these, or else constituted by an end flap of the faces 13*a*, 13*b* likely to trap a certain volume of air. As shown in FIGS. 4A and 4B, the pneumatic pocket 14 can be constituted by two fenders each extending over half the periphery of the chute 6.

It will be noted that the fact of adding to each face 13*a*, 13*b* a float 14 independent of that of the opposite face and extending over approximately the entire length of the face 13*a*, 13*b* leads to making the flotation force act over the entire width of the face and applying the two faces 13*a*, 13*b* against each other with improved effectiveness conferring a seal tight enough to prevent the external water from flowing back into the raft.

Figure 5:
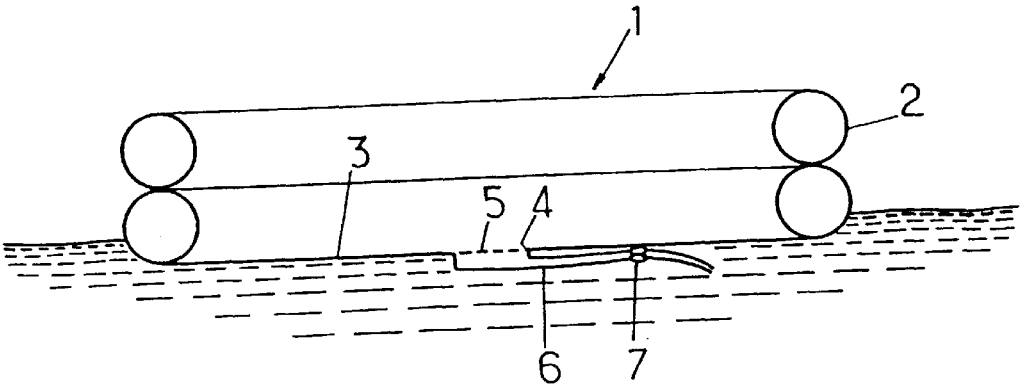
FIG. 5 is an outline diagrammatic view similar to that in FIG. 2, showing a version variant of the dump valve device of the invention.
Figure 4C:
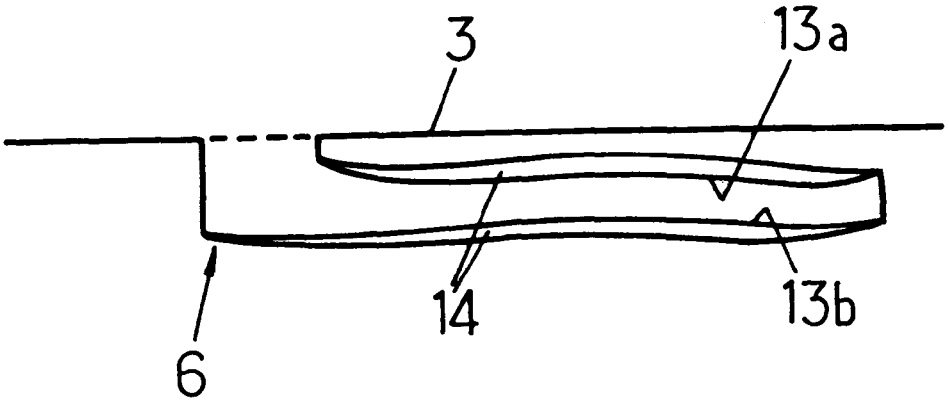
FIG. 4C is an outline diagrammatic view in longitudinal cross-section of a dump valve device according to the invention.
Figure 4D:
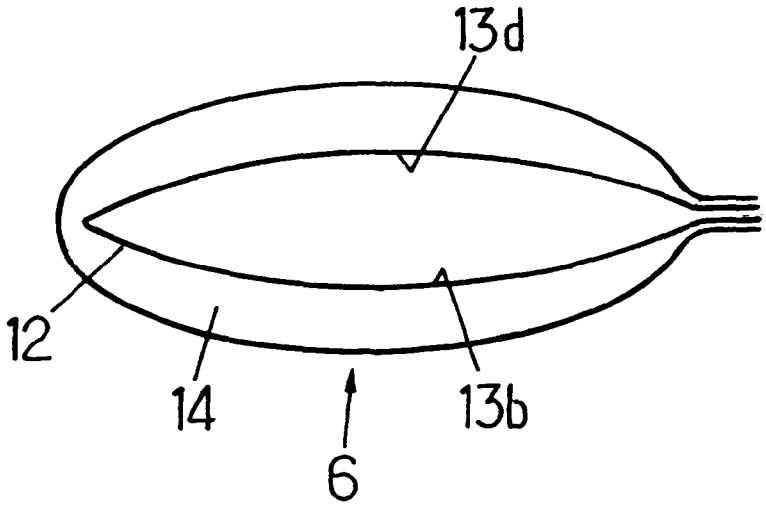
FIG. 4D is an outline diagrammatic view in cross-section of another version of the end of a dump valve device according to the invention.

It may also be imagined that it is not mandatory for the flotation means 7 to be located at the free end of the chute 6, indeed they can just as well be placed away from this end, as shown in FIG. 5. The flotation means 7 have only to be located away from the connection of the chute 6 with the hole 4 in the raft bottom 3.

What is claimed is:

1. A boat having a bottom and provided with an automatically operating dump valve devices, said device including a hole made in the bottom of the boat and an approximately flexible chute located under the bottom of the boat being connected in a sealed way to the edge of said hole, said chute being equipped with flotation means placed away from its connection with the hole in the bottom of the boat, by means of which arrangement, when there is no water in the boat, the flotation means bring the chute back up under the bottom of the boat approximately sealing up said chute and the water cannot get into the boat through the chute, whereas, when water is present in the boat and is drawn back towards the aforementioned hole, its weight forces the chute to drop from the bottom of the boat despite the presence of the flotation means and the water flows out through the chute.

2. A boat according to claim 1, in which the flotation means are placed at the end or near the end of the chute.

3. A boat according to claim 1, in which the flotation means are placed away from the end of the chute.

4. A boat according to claim 1, in which the flotation means comprise at least one pneumatic pocket.

5. A boat according to claim 4, in which the pneumatic pocket is formed of at least one hermetically sealed fender containing air and extending over the periphery of the chute.

6. A boat according to claim 5, in which the pneumatic pocket is constituted by two fenders each extending over half the periphery of the chute.

7. A boat according to claim 5, in which the pneumatic pocket is constituted by two fenders each extending over half the periphery of the chute and in that the chute is, in the absence of water outflow, of a flattened shape and has two faces placed one against the other each being provided with one of the fenders, the flattened chute being, in the raised position activated by the flotation means, pinned flat under the bottom of the boat.

8. A boat according to claim 5, in which the pneumatic pocket is constituted by two fenders each extending over half the periphery of the chute and in that the chute is, in the absence of water outflow, of a flattened shape and has two faces placed one against the other each being provided with one of the fenders, the flattened chute being, in the raised position activated by the flotation means, pinned flat under the bottom of the boat and in that the chute is formed of two sheets of a flexible material placed flat against each other and fixed to each other by their respective edges.

9. A boat according to claim 1, in which the chute has a mouth connected to the hole provided in the bottom of the boat, the mouth being placed laterally on the chute so that the chute in operational position extends approximately parallel to the bottom.

10. A boat according to claim 1, in which the chute is constituted of a substantially flexible synthetic material.

11. A boat according to claim 1 in which the chute has a mouth fixed to the hole in the bottom of the boat, the mouth being equipped with a protective grating.

12. A boat according to claim 1 constituting a life raft.

13. A boat having a bottom and comprising:

a. an opening through which water may flow; and b. a chute connected to the opening for receiving water flowing therethrough for disposal outside the boat, the chute (i) having an elongated flexible portion extending underneath the bottom of the boat and (ii) including at least one float positioned so as to prevent significant water flow into the boat.

14. A boat according to claim 13 in which the float is connected to the chute.

* * * * *